US007210441B1

(12) United States Patent
Burns

(10) Patent No.: US 7,210,441 B1
(45) Date of Patent: May 1, 2007

(54) PRIMING AND PURGING SYSTEM AND METHOD FOR AN INTERNAL COMBUSTION ENGINE

(75) Inventor: Michael P. Burns, Millington, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 196 days.

(21) Appl. No.: 11/105,902

(22) Filed: Apr. 14, 2005

(51) Int. Cl.
*F02M 1/16* (2006.01)
*F02N 17/00* (2006.01)

(52) U.S. Cl. ..... 123/179.11; 261/35

(58) Field of Classification Search ..... 123/179.11, 123/179.7, 179.13, 179.14, 179.15, DIG. 5; 261/35
See application file for complete search history.

(56) References Cited

U.S. PATENT DOCUMENTS 4,271,093 A * 6/1981 Kobayashi ..... 123/179.11
4,836,157 A 6/1989 Miller
4,848,290 A 7/1989 Miller
4,905,641 A 3/1990 Miller
5,545,357 A * 8/1996 Radel et al. ..... 261/35
6,425,573 B1 7/2002 Suzuki
6,481,403 B1 * 11/2002 Ashcraft et al. ..... 123/179.11
6,561,495 B2 5/2003 Woody
2005/0109303 A1 * 5/2005 Oyamada et al. ..... 123/179.11

* cited by examiner

*Primary Examiner*—Stephen K. Cronin
*Assistant Examiner*—Arnold Castro
(74) *Attorney, Agent, or Firm*—Reising, Ethington, Barnes, Kisselle, P.C.

(57) ABSTRACT

A priming and purging system and method for an internal combustion engine having a diaphragm carburetor includes a pump in fluid communication with the carburetor, a portion of the engine, and a fuel tank. The pump is manually actuatable to draw liquid fuel and any fuel vapors and gases from the carburetor and to deliver at least some liquid fuel into a portion of the engine to prime the engine and liquid fuel and any fuel vapor and gases toward and preferably into the fuel tank to facilitate purging the carburetor.

20 Claims, 3 Drawing Sheets

PRIMING AND PURGING SYSTEM AND METHOD FOR AN INTERNAL COMBUSTION ENGINE

FIELD OF THE INVENTION

The present invention relates generally to fuel systems for small internal combustion engines, and more particularly to fuel priming and vapor purging systems and methods for small internal combustion engines.

BACKGROUND OF THE INVENTION

Small internal combustion engines often have a manually operated purge pump in fluid communication with a carburetor to allow fuel vapor and stale liquid fuel to be purged from the carburetor, or a prime pump to prime the carburetor with a shot of liquid fuel to facilitate starting the engine. The pumps have a manually actuated bulb and are generally attached directly to the carburetor, or located remotely from the carburetor. The purge pump is actuated to a depressed state, thereby causing liquid fuel and fuel vapor within the bulb to be directed through a downstream fuel line to a fuel tank. The purge pump is then returned to a non-depressed state, thereby drawing liquid fuel and any fuel vapor into the bulb through an upstream fuel line. The purging is generally repeated as necessary to ensure that the fuel vapor is purged from the upstream fuel line. The prime pump bulb is similarly actuated to a depressed state, however, rather than directing the flow into the fuel tank, the flow is typically directed into an air-fuel mixing passage of the carburetor to prime the carburetor.

Sometimes users mistake the purge pump for a prime pump and limit the number of actuations of the pump out of fear of "flooding" the engine. As a result, the carburetor may not be fully purged of fuel vapor prior to initiating a starting procedure for the engine, thus, making starting the engine difficult. Similarly, sometimes users mistake the prime pump for a purge pump and actuate the prime pump in excess, thereby causing the engine to be "flooded." As a result, starting the engine is made more difficult, rather than being made easier.

SUMMARY OF THE INVENTION

A priming and purging system for an internal combustion engine having a diaphragm carburetor. The carburetor has a pump chamber in operable communication with a crankcase of the engine and a metering chamber downstream from the pump chamber for regulating at least in part the flow of liquid fuel into an air-fuel mixing passage of the carburetor. The priming and purging system includes a pump having an inlet in fluid communication with the metering chamber and an outlet. The outlet of the pump communicates with both the engine and the fuel tank. The pump is manually actuatable to draw liquid fuel and gaseous phase air, fuel vapor and/or fuel bubbles through the inlet of the pump from the metering chamber, and also to pump liquid fuel and gaseous phase through the pump to the fuel tank and dispense priming liquid fuel to a portion of the engine such as the mixing passage of the carburetor, intake manifold, or crankcase of a two-stroke engine for admission to the combustion chamber.

Preferably, the fluid flows to the engine and the fuel tank through check valves which preferably open at different pressures with the flow to the tank beginning at a lower pressure than the pressure at which flow to the fuel engine begins.

Another aspect of the invention provides a method of purging gaseous phase presence from a liquid fuel metering chamber of a diaphragm carburetor for an internal combustion engine and dispensing a priming shot of liquid fuel into a portion of the engine to facilitate starting the engine. The method includes providing a carburetor having a pump chamber operable in response to pressure pulses from a crankcase of the engine and being in fluid communication with a metering chamber downstream therefrom. The metering chamber has a flexible diaphragm movable in response to pressure differential between atmospheric pressure and engine-intake-induced negative pressure in the air-fuel mixing passage to pump liquid fuel from the metering chamber into the air-fuel mixing passage to form an air-fuel mixture for operating the engine. Further, providing a pump having an inlet in fluid communication with the metering chamber and an outlet communicating with a portion of the engine and a fuel tank. The pump is arranged for manual actuation to draw the gaseous phase and liquid fuel through the inlet from the metering chamber and to pump the gaseous phase and liquid fuel through the outlet of the pump and to the fuel tank and priming liquid fuel into a portion of the engine.

The priming and purging system facilitates starting the internal combustion engine by inhibiting the gaseous phase and stale liquid fuel within the metering chamber from reaching the air-fuel mixing passage of the carburetor, while also providing a priming shot of liquid fuel to a portion of the engine.

Some of the objects, features and advantages of the invention include providing a priming and purging system and method that automatically purges gaseous phase and stale liquid fuel from a carburetor while priming the engine at the same time, reduces the number of steps to start an engine, improves the ease in starting an engine, maintains a supply of liquid fuel adjacent an air-fuel mixing passage of a carburetor, is relatively simple in design and manufacture, is economical in manufacture, and has a long useful life in service.

BRIEF DESCRIPTION OF THE DRAWINGS

These and other objects, features and advantages of this invention will be apparent in view of the following detailed description of the presently preferred embodiments and best mode, appended claims and accompanying drawings, in which:

DETAILED DESCRIPTION OF THE PRESENTLY PREFERRED EMBODIMENTS

Figure 1:
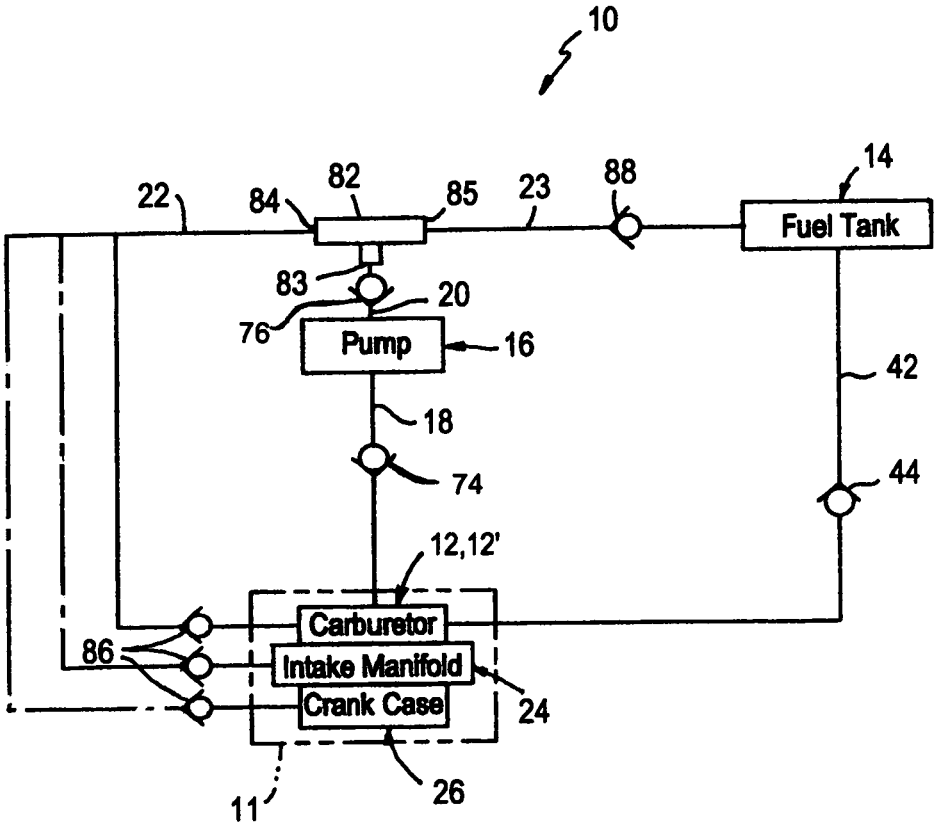
FIG. 1 is a schematic view of a priming and purging system according to some presently preferred embodiments of the invention.

Referring in more detail to the drawings, FIG. 1 illustrates a priming and purging system 10 of an internal combustion engine 11 arranged according to some presently preferred embodiments of the invention. The system 10 is in fluid communication with a carburetor 12 and a fuel tank 14, and can be arranged in fluid communication with other portions of the engine 11, such as, by way of example and without limitation, an intake manifold 24 and a crankcase 26 of a two-stroke engine. The system 10 includes a start pump 16 that is manually actuatable to draw or purge gaseous phase, referred to hereafter as fuel vapor, and stale liquid fuel from the carburetor 12 via a fuel passage 18 upstream of the start pump 16 and preferably to direct the fuel vapor and liquid fuel away from the pump 16 via another fuel passage, referred to hereafter as a first fuel passage 20, downstream of the start pump 16. The first fuel passage 20 preferably diverges into a pair of fuel passages, referred to hereafter as a second fuel passage 22 and a third fuel passage 23. To facilitate purging the carburetor 12, the third fuel passage 23 preferably communicates with the fuel tank 14 to dispense fuel vapor and liquid fuel into the fuel tank 14. While at the same time the pump 16 purges the carburetor 12, it also directs a priming shot of liquid fuel through the second fuel passage 22, downstream of the start pump 16, to a portion of the engine 11, and shown here as at least one of the carburetor 12, the intake manifold 24, and the crankcase 26 of the engine 11. Accordingly, the system 10 ensures that the carburetor 12 receives fresh, liquid fuel that preferably is essentially free of fuel vapor while starting the engine 11, and also ensures that the engine 11 is primed with liquid fuel, thereby improving the ease with which the engine 11 is started.

Figure 2:
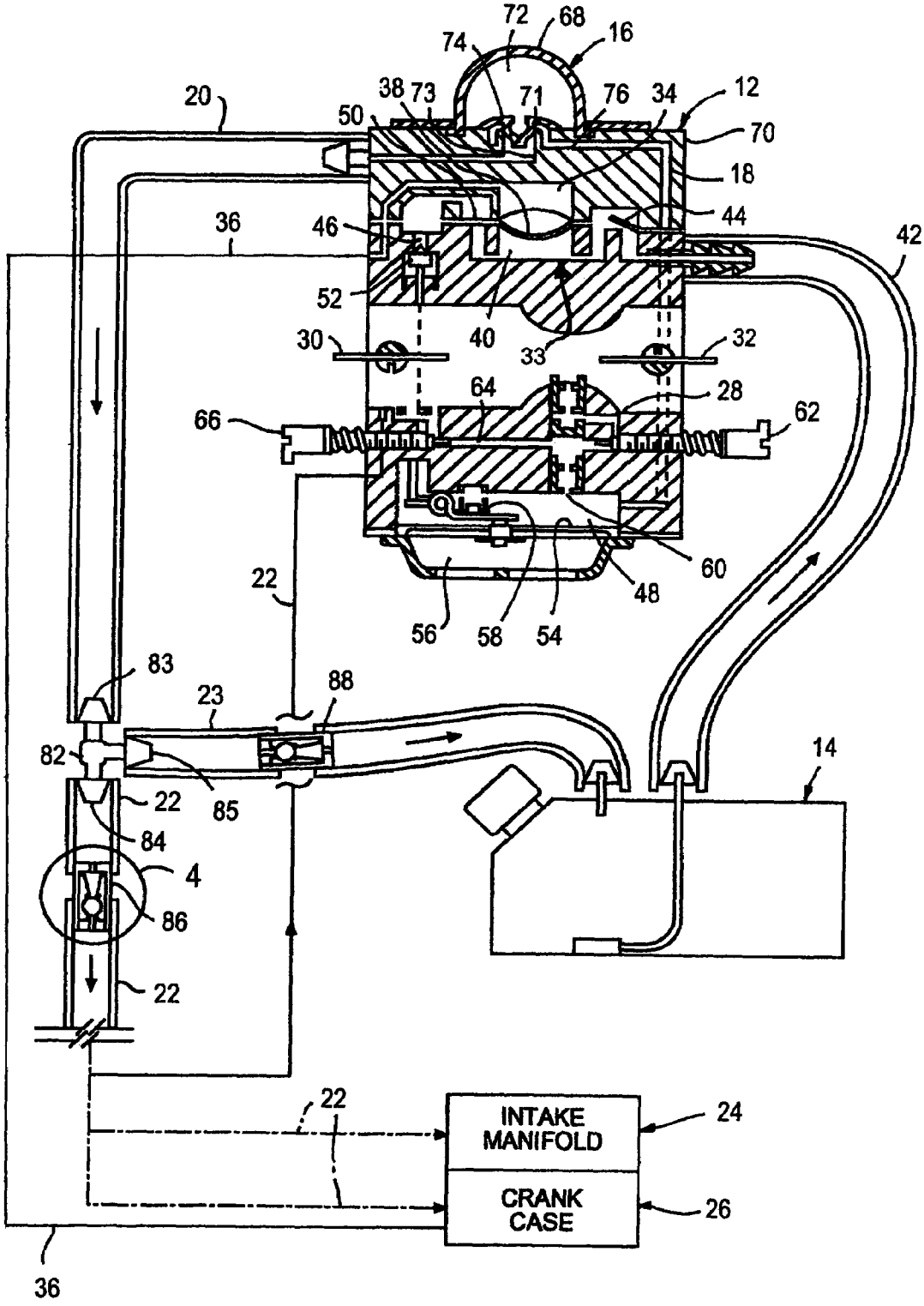
FIG. 2 is a cross-sectional view of a carburetor with a priming and purging pump system of a presently preferred embodiment of the invention shown schematically arranged in fluid communication with one of an air-fuel mixing passage of the carburetor, an intake manifold of an engine, and a crankcase of a two-stroke engine.

As shown in FIG. 2, the carburetor 12 is represented here as a diaphragm carburetor 12 having an intake or air-fuel mixing passage 28 with a butterfly-type throttle valve 30 received at least in part in the mixing passage 28 for movement between idle and wide open positions. The carburetor 12 is shown here, by way of example and without limitation, as having a choke valve 32 received at least in part in the mixing passage 28 upstream of the throttle valve 30 for movement between a closed position to facilitate cold starts, and an open position during normal operation of the engine 11. The carburetor 12 preferably supports a fuel pump 33 having a pressure chamber 34 communicating with the crankcase 26 of the engine 11 via a passage 36 to receive pulsating pressure therefrom. A resiliently flexible diaphragm 38 of the fuel pump 33 separates the pressure chamber 34 from a pump chamber 40 which communicates with the fuel tank 14 via a fuel passage 42. As the pump diaphragm 38 is flexed or reciprocated by the pulsating pressure from the crankcase 26, a check valve 44 allows liquid fuel to flow to the pump chamber 40 and prevents the reverse flow of liquid fuel from the pump chamber 40 back toward the fuel tank 14.

A fuel passage 46 communicates the pump chamber 40 with a fuel metering chamber 48 downstream of the pump chamber 40, with the metering chamber 48 preferably being defined in a lower portion of the carburetor 12. The fuel passage 46 preferably has a one-way check valve 50 between the pump chamber 40 and the metering chamber 48 to facilitate regulating the flow of liquid fuel therebetween. The check valve 50 closes when the pump diaphragm 38 draws fuel from the fuel tank 14, and opens when the pump diaphragm 38 pushes the fuel into the metering chamber 48, as is known. To further regulate the flow of liquid fuel through the passage 46 and into the metering chamber 48, preferably a pivotally supported fuel inlet valve 52 movable between open and closed positions is interposed between the pump chamber 40 and the metering chamber 48, and preferably between the check valve 50 and the metering chamber 48.

The metering chamber 48 is defined in part by one side of a diaphragm 54, and an atmospheric chamber 56 is defined on the opposite side of the diaphragm 54. As is known, the diaphragm 54 flexes or moves in response to a pressure differential across it to control movement of the fuel inlet valve 52 between its open and closed positions. When the pressure in the metering chamber 48 is less than the pressure in the atmospheric chamber 56, the diaphragm 54 moves or flexes upwardly and moves the fuel inlet valve 52 to its open position. When the pressure in the metering chamber 48 is equal to or greater than the pressure in the atmospheric chamber 56, the fuel inlet valve 52 remains in its closed position, and may be biased to its closed position by a spring 58, as is known.

The metering chamber 48 is in fluid communication with the throttle bore or air-fuel mixing passage 28 via a main fuel passage 60, which is regulated in part by a high speed needle valve 62 and a low speed or idle fuel passage 64, regulated in part by a low speed needle valve 66. The liquid fuel is dispensed into the air-fuel mixing passage 28 through the main fuel passage 60 and the idle fuel passage 64 at a desired flow rate, depending on the relative positions of the needle valves 62, 66, the relative positions of the throttle and choke valves 30, 32 and the relative pressures between the air-fuel mixing passage 28 and the metering chamber 48, as is known.

Figure 3:
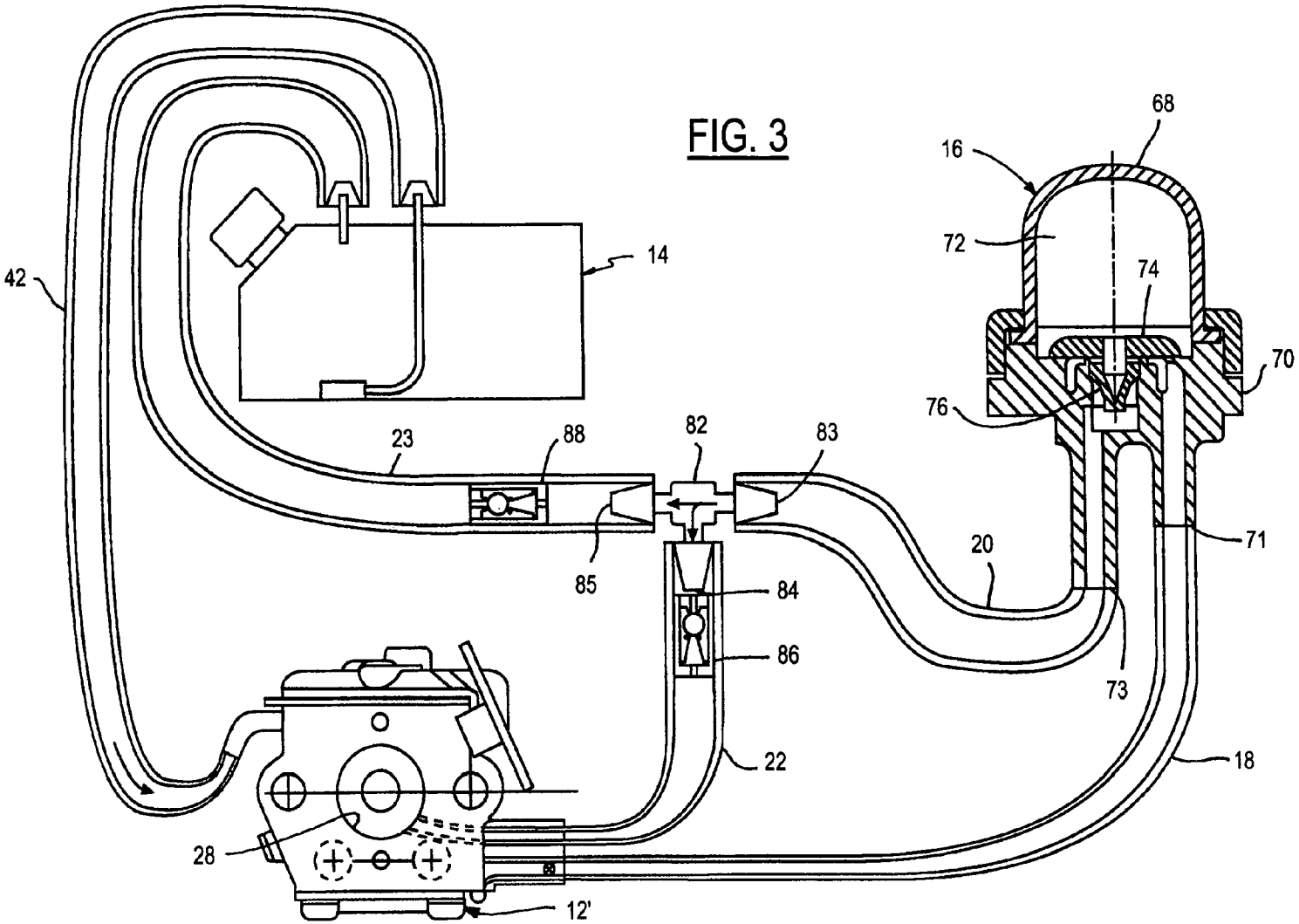
FIG. 3 is a partial cross-sectional view of a priming and purging pump system of another presently preferred embodiment of the invention shown schematically arranged in fluid communication with a fuel tank and a carburetor.

The metering chamber 48 is preferably in direct fluid communication with the manual pump 16 via the fuel passage 18 upstream of the pump 16, wherein the pump 16 can be carried by the carburetor 12, or, as shown in FIG. 3, can be carried remotely from a carburetor 12' which has essentially the same construction as carburetor 12. As such, the fuel passage 18 can span a short or relatively long distance, as necessary, depending on the proximity of the pump 16 to the carburetor 12, 112.

The pump 16, by way of example and without limitation, can be a diaphragm pump, a positive displacement piston-type pump, or as shown in FIGS. 2 and 3, a bulb-type pump having an inlet 71 in fluid communication with the metering chamber 48 via the fluid passage 18 and an outlet 73 in fluid communication with the first fuel passage 20. The pump 16 has a resilient dome shaped bulb 68 sealed about its periphery to a housing 70 to define a pump chamber 72. The chamber 72 encapsulates the fuel passage 18 from the metering chamber 48 and the first fuel passage 20 flowing downstream from the pump 16. The pump 16 includes a one-way valve, represented here by way of example and without limitation, as an umbrella shaped valve 74, overlying the fuel passage 18 from the metering chamber 48. The valve 74 allows a flow of fuel vapor and liquid fuel from the metering chamber 48 into the pump chamber 72 while preventing a reverse flow from the pump chamber 72 toward the metering chamber 48. The pump 16 includes another one-way valve, represented here by way of example and without limitation, as a duck bill-shaped valve 76 received in an inlet of the first fuel passage 20 and preferably constructed integrally and as one piece with the umbrella valve 74. The valve 76 allows a flow of fuel vapor and liquid fuel from the pump chamber 72 into the first fuel passage 20 while preventing a reverse flow from the first fuel passage 20 into the pump chamber 72.

The first fuel passage 20 is preferably connected in fluid communication to the second and third fuel passages 22, 23 via a T-shaped connector 82. The connector has an inlet 83 arranged for a sealed connection to the first fuel passage 20 and a pair of outlets 84, 85 arranged for a sealed connection to the second and third fuel passages 22, 23, respectively.

Figure 4:
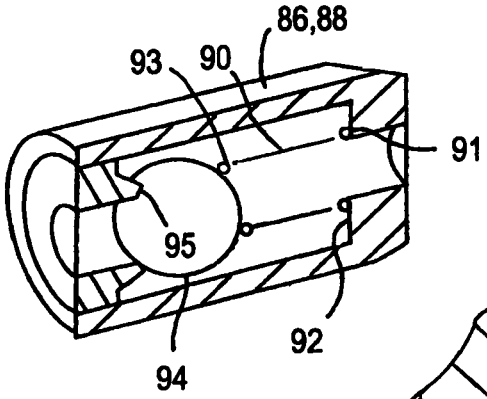
FIG. 4 is a perspective view of a one-way valve constructed according to one presently preferred embodiment of the invention.

The second and third fuel passages 22, 23 are in fluid communication with the engine 11 and the fuel tank 14, respectively, and preferably have first and second one-way check valves 86, 88 therein, respectively, to regulate the flow rate of the liquid fuel through the fuel passage 22, 23. As best shown in FIG. 4, the check valves 86, 88 are represented here, by way of example and without limitation, as spring biased check valves that ordinarily remain closed until acted on by a pressure great enough to overcome a biasing force imparted by a coil spring 90. The spring has one end 91 in engagement with an end wall 92 of the check valve, and another end 93 in engagement with a ball 94 within the check valve. The ball 94 is yieldably biased into sealed engagement with a valve seat 95, wherein the valve seat is represented here, for example, as being press-fit into a body of the check valves 86, 88.

The first and second check valves 86, 88 can be arranged to crack or open at a selected or predetermined pressure to regulate the flow of liquid fuel through the respective fuel passages 22, 23, depending on the requirements of the specific engine arrangement. For instance, the pressures at which the check valves 86, 88 crack can be changed, such as, for example, by changing the spring rate and/or force characteristics and/or by changing the extent to which the spring is compressed between the valve seat 95 and the end wall 92. Preferably, but not necessarily, the first check valve 86 is arranged to crack at a different pressure from the second check valve 88, and more preferably at a pressure that is greater than the pressure required to crack the second check valve 88. This facilitates stale fuel and any fuel vapor or air being directed toward the fuel tank and fresh liquid fuel being directed to the engine for priming it. By way of example and without limitation, preferably the spring 90 in the first check valve 86 in the second fuel passage 22 is selected to compress and open the valve under a pressure of about 3 psi, whereas the spring 90 in the second check valve 88 is selected to compress and open the valve under a pressure of about 2 psi.

To start the engine, whether it is cold or already warmed from use, the pump 16 can be manually actuated by depressing the bulb 68 to purge the carburetor 12 and to prime the engine 11. When flexing or depressing the bulb 68, the volume of vapor and/or liquid fuel within the pump chamber 72 is pumped through the first fuel passage 20, through the connector 82, and through the second and third fuel passages 22, 23, respectively. As the bulb 68 is released and returns to its relaxed domed shape, a vacuum is drawn in the fuel passage 18, thereby drawing liquid fuel and any air and fuel vapor from the metering chamber 48 into the pump chamber 72. The pump 16 can be manually actuated, preferably a prescribed number of times, without flooding the engine 11. The priming shot(s) of liquid fuel is delivered via the second fuel passage 22 to at least one of the air-fuel mixing passage 28, intake manifold 24, and crankcase 26. To facilitate delivering the fuel shot to the intake manifold 24, the outlet of the second fuel passage 22 can be angled or inclined to dispense a fine stream of liquid fuel directly into the intake manifold 24. The second fuel passage 22 could have an outlet dispensing liquid fuel into the air-fuel mixing passage 28, preferably downstream from the throttle valve 30, and/or into the intake manifold 24 downstream from the air-fuel mixing passage 28. The outlet preferably has a diameter of about 0.4–0.5 mm to create a fine stream of liquid fuel, though any suitable diameter could be used, depending on the spray pattern or stream desired. As such, a sufficient amount of liquid fuel is dispensed through the second fuel passage 22 to prime the engine 11, while ensuring that the engine 11 is not flooded with too much liquid fuel, preferably substantially regardless of the number of times the pump 16 is actuated. The liquid fuel and any gases such as fuel vapor and air flowing through the third fuel passage 23 is preferably dispensed into the fuel tank 14 to purge the carburetor 12.

Figure 5:
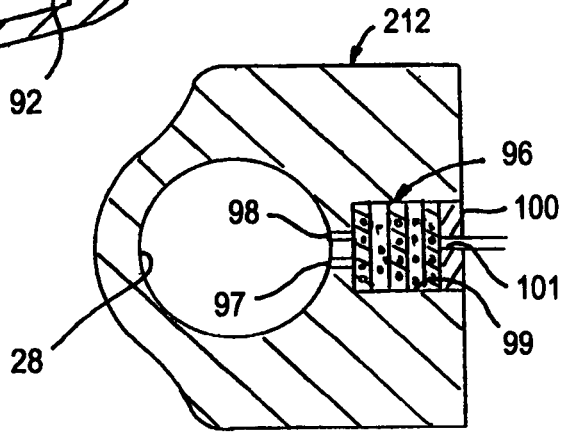
FIG. 5 is a partial cross sectional view of a carburetor constructed according to another embodiment of the invention.

As shown in FIG. 5, another carburetor 212 constructed according to another presently preferred embodiment of the invention has a reservoir 96, shown here, by way of example and without limitation, generally adjacent the air-fuel mixing passage 28. An opening or plurality of openings 97, 98 are arranged to communicate the reservoir 96 with the air-fuel mixing passage 28. A piece of porous material 99 is sized for receipt within the reservoir 96 and is preferably maintained in a fixed position, such as through the use of a closure or washer 100 press-fit in an end of the reservoir 96. The washer 100 has an opening 101 arranged for fluid communication with the second fluid passage 22, thereby allowing liquid fuel to flow from the second fluid passage 22 into the reservoir 96. As such, the porous material 99 is able to be wetted or saturated with liquid fuel, thereby providing a supply of liquid fuel adjacent the air-fuel mixing passage 28 to facilitate priming the engine 11. The material 99 can be any suitable porous material that is compatible with liquid fuel, such as a metallic mesh or Porex®, for example.

The embodiments of the starter system 10 discussed above are intended to be illustrative of presently preferred embodiments of the invention, and are not limiting. Various modifications within the spirit and scope of the invention will be readily apparent to those skilled in the art. For example, the pressure at which each check valve 86, 88 opens may be varied relative to the fuel pressure produced by the pump 16 and the quantity of fuel needed to prime a particular engine.

The invention claimed is:

1. A priming and purging system for an internal combustion engine having a fuel tank and a diaphragm carburetor with a fuel pump in operable communication with a crankcase of the engine to pump liquid fuel from the fuel tank into the carburetor and a metering chamber downstream from the fuel pump for regulating at least in part the flow of liquid fuel into an air-fuel mixing passage of the carburetor, the priming and purging system, comprising:

a start pump having an inlet in fluid communication with the metering chamber and an outlet in fluid communication with both the engine and the fuel tank; and the start pump being actuatable to draw liquid fuel and any fuel vapor and gases from the metering chamber and to pump the liquid fuel and any fuel vapor and gases through the outlet and toward the fuel tank and at least some liquid fuel into a portion of the engine for priming the engine.

2. The priming and purging system of claim 1 further comprising a first valve movable between open and closed positions to control fluid flow to the engine and a second valve movable between open and closed positions to control fluid flow to the fuel tank and the first and second valves being biased toward their closed positions and being movable toward their open positions in response to fuel pressure.

3. The priming and purging system of claim 2 wherein the first valve moves toward its open position under a first pressure and the second valve moves toward its open position under a second pressure, the first pressure being greater than the second pressure.

4. The priming and purging system of claim 1 wherein the fluid flow to the engine communicates with the air-fuel mixing passage.

5. The priming and purging system of claim 4 wherein a throttle valve is received in the air-fuel mixing passage and the fluid flow to the engine communicates with the air-fuel mixing passage downstream of the location of the throttle valve when closed.

6. The priming and purging system of claim 1 wherein the fluid flow to the engine communicates with an intake manifold of the engine downstream from the air fuel mixing passage.

7. The priming and purging system of claim 1 wherein the start pump is carried by the carburetor.

8. The priming and purging system of claim 1 wherein the start pump is remote from the carburetor.

9. The priming and purging system of claim 1 further comprising a reservoir adjacent the air-fuel mixing passage and a porous material received in the reservoir to receive a supply of liquid priming fuel adjacent the air-fuel mixing passage.

10. The priming and purging system of claim 9 further comprising a plurality of openings communicating the reservoir with the air-fuel mixing passage.

11. A method of purging any fuel vapor and gases from a liquid fuel metering chamber of a diaphragm carburetor for an internal combustion engine, and dispensing a priming liquid fuel into a portion of the engine to facilitate starting the engine, the method comprising the steps of:

providing a carburetor having a fuel pump operable in response to pressure pulses from a crankcase of the engine, the fuel pump being in fluid communication with a metering chamber downstream from the fuel pump, the metering chamber having a flexible diaphragm movable in response to a pressure differential between atmospheric pressure and engine-intake-induced negative pressure in the air-fuel mixing passage to dispense liquid fuel from the metering chamber into the air-fuel mixing passage to form an air-fuel mixture for operating the engine;

providing a start pump having an inlet in fluid communication with the metering chamber and an outlet in fluid communication with both the portion of the engine and a fuel tank; and arranging the inlet of the start pump to draw liquid fuel and any fuel vapor and gases through the inlet from the metering chamber and to pump the liquid fuel and any fuel vapor and gases through the outlet and toward the fuel tank and at least some liquid fuel to the engine to prime the engine for starting.

12. The method of claim 11 including providing a first valve to control fluid flow to the engine and arranged for movement from a closed position toward an open position under a first pressure and providing a second valve to control fluid flow to the fuel tank and arranged for movement from a closed position toward an open position under a second pressure.

13. The method of claim 12 including arranging the first and second valves so that the first pressure is greater than the second pressure.

14. The method of claim 11 including arranging the fluid flow to the engine to communicate with the air-fuel mixing passage.

15. The method of claim 11 including arranging the second fluid flow to the engine to communicate with the crankcase.

16. The method of claim 11 including arranging the fluid flow to the engine to communicate with an intake manifold of the engine.

17. A priming and purging system for an internal combustion engine having a diaphragm carburetor with a fuel pump in operable communication with a crankcase of the engine to pump liquid fuel from a fuel tank into the carburetor and a metering chamber downstream from the fuel pump for regulating at least in part the flow of liquid fuel into an air-fuel mixing passage of the carburetor, the priming and purging system, comprising:

a start pump with an inlet in fluid communication with the metering chamber and an outlet;

a fuel passage in fluid communication with the outlet and the engine and having a first valve therein;

a fuel passage in fluid communication with the outlet and the fuel tank and having a second valve therein; and the start pump being manually actuatable to draw liquid fuel and any fuel vapor and gases from the metering chamber portion of the carburetor into the start pump and to dispense liquid fuel and any fuel vapors and gases toward the fuel tank and liquid fuel into the engine with the liquid fuel flow into a portion of the engine being regulated via the first valve and the liquid fuel and any fuel vapor and gases flow toward the fuel tank being regulated via the second valve.

18. The priming and purging system of claim 17 wherein the first valve is biased toward a closed position and moves toward an open position at a first pressure and the second valve is biased toward a closed position and moves toward an open position at a second pressure, the first and second pressures being different.

19. The priming and purging system of claim 18 wherein the first pressure is greater than the second pressure.

20. The priming and purging system of claim 17 wherein at least the liquid fuel flowing into the engine is dispensed into the air-fuel mixing passage and the liquid fuel and any fuel vapors and gases flowing toward the fuel tank is dispensed into the fuel tank.

* * * * *